US005310205A

United States Patent [19]

Piegay et al.

[11] Patent Number: 5,310,205

[45] Date of Patent: May 10, 1994

[54] SKI SOLE

[75] Inventors: Yves Piegay, Meyrieu les Etangs; Adrien Duvillard, Megeve, both of France

[73] Assignee: Skis Rossignol SA, France

[21] Appl. No.: 990,066

[22] Filed: Dec. 14, 1992

[30] Foreign Application Priority Data

Dec. 20, 1991 [FR] France ..... 91 16207

[51] Int. Cl.[5] ..... A63C 5/044

[52] U.S. Cl. ..... 280/610; 280/608

[58] Field of Search ..... 280/601, 610, 608, 609

[56] References Cited

U.S. PATENT DOCUMENTS 4,706,985 11/1987 Meatto ..... 280/610
4,813,699 3/1989 Burger et al. ..... 280/610

FOREIGN PATENT DOCUMENTS 8806105 8/1988 Fed. Rep. of Germany .
273544 11/1989 Fed. Rep. of Germany .
2564737 11/1985 France .
2568479 2/1986 France .
2650961 2/1991 France .
671707 9/1989 Switzerland .

*Primary Examiner*—Margaret A. Focarino
*Assistant Examiner*—Michael Mar
*Attorney, Agent, or Firm*—Harris Beach & Wilcox

[57] ABSTRACT

A ski sole having a first section situated in the ski runner region and two other sections corresponding to the two ends of the ski. The first section is fabricated of a material having a greater hardness than that of the two other sections.

15 Claims, 1 Drawing Sheet

SKI SOLE

BACKGROUND OF THE INVENTION

The invention relates to a sole for a ski, and in particular for a downhill ski.

Apart from a certain resistance to wear, the essential quality required for ski soles relates to their sliding capability.

The phenomena of sliding on snow or ice have been widely studied, and it emerges from these findings that sliding is principally inherent in the formation of a film of water below the sole, which facilitates and promotes the resulting sliding. This film of water is created as a result of the phenomena of friction of the sole on the snow or the ice, which give rise to a local temperature rise and consequently the melting of the snow or of the ice in this region.

The friction brought about by the sole is dependent on the one hand on the distribution of the weight of the skier in the region of the sole and on the other hand on the positioning of the ski in relation to the slope, according to whether the skier is in the course of turning or in a straight line, but is also dependent on the speed and in a general manner on the dynamics of the skier in the course of maneuvering in relation to the snow or the ice.

In fact, it has been possible to demonstrate that on the flat the distribution of pressure in the region of the ski takes place essentially in the region of the runner and, to a lesser degree, in the region of the lines of contact, front and rear respectively, of the ski. On the other hand, the pressure exerted is rather weak in the region of the other places of the sole.

This distribution of pressure is quite different as soon as the skier carries out turns. In fact, in such a case, it has been possible to show that in a turn the ski rested essentially on a fold of snow formed by the maneuvering of the ski, and this in the region of a very small portion of the surface of its sole and typically in the region of the lateral edge resting on the snow and that moreover this pressure was maximum in the region of the runner.

In fact, the pressure generated in the region of the runner is moreover accentuated by the dynamic effect which is added to the purely static effect inherent in the weight of the skier.

SUMMARY OF THE INVENTION

It was therefore attempted, in order to optimise the sliding properties of such soles, to select in the region of this runner zone a material capable of optimising these properties, given that the major part of the pressure is exerted in this region.

The principle of modifying the structure or the composition of the sole in the region of the runner is already known per se. For example, in the document FR-A-2 564 737, a sole for a ski, in particular for a cross-country ski, was proposed, comprising a central zone constituted by a mixture of polyethylene and elastomer, which gives it a high coefficient of friction in relation to the rest of the sole. In this manner, this central zone or runner is given the particular properties of catching required for the cross-country ski. Nevertheless, and as can easily be understood, this particular sole does not, on the contrary, optimise the sliding properties.

In the document FR-A-2 650 961, a ski sole has also been proposed, in which the rear two thirds of the sole are constituted by a material of low hardness, that is to say in the region of the zone in which the pressure is greatest, and in which the front zone of the sole is constituted by a material of high hardness.

In one case as in the other, the results observed do not make it possible to arrive at optimised sliding properties, in particular in turning. The aim of the invention is to propose a sliding sole which makes it possible to take into account the distribution of pressure during use of the ski, in particular in turning, in order properly to promote sliding.

This ski sole, the covering of the lower surface, known as sliding surface, of which comprises different surface portions, a first portion situated in the region of the zone of the runner and two other portions corresponding to the two ends of the ski, is characterized in that the first portion is made of a material of greater hardness than the other two portions.

In other words, the aim of the invention consists in making the lower sliding surface of the sole, in the region of the zone of the runner, of a material of clearly greater hardness than that of the two ends. In this manner, and contrary to the teachings of the document FR-A-2 650 961 which recommends the use of material of lower hardness in the region of the zones of great pressures, the invention proposes in particular in the region of the runner the use of a material of high hardness and having a lower coefficient of friction, which promotes in an unexpected manner the phenomena of sliding. It has in fact been realized that in doing so a ski was obtained, the sliding properties of which were particularly optimised, in particular during maneuvering in turning.

According to a particularly advantageous embodiment of the invention, the zone of the runner is not entirely constituted by such a material of high hardness, only the vicinity of the two lateral edges of the runner being thus constituted. Typically, these two edges extend all along the zone of the runner, over a width of approximately one centimeter.

In known manner, the sole is made of plastic material, and in particular of polyethylene. Material of greater hardness therefore means a material having a greater resistance to abrasion.

Advantageously, the resistance to abrasion of the zone of the runner is effected by means of a standardized test which is well known among manufacturers and converters of plastic materials under the name SAND-SLURRY test. This test consists in subjecting samples, of given dimensions, in particular 76.2 mm×25.4 mm×6.35 mm, to a rotation at a speed of 1200 revolutions per minute for a period of 24 hours in a medium consisting of two parts by weight of water for three parts by weight of quartz sand, the grain size distribution of which is comprised between 0.2 and 1 millimeter.

A loss in weight is thus measured, which is converted, taking account of the density, to a loss in volume. The loss in volume of a reference product "HOSTALEN GUR" from HOECHST, constituted by a high-density polyethylene powder of a molecular weight of 2,000,000, is arbitrarily fixed at the value 100, the abrasion of the other products being expressed in the form of a relative volumetric abrasion by proportionality in relation to this reference. Thus, the lower the value obtained, the better the resistance to abrasion.

According to the invention, the zone of the runner has a resistance to abrasion coefficient measured by SAND-SLURRY test at most equal to 100, while the front and rear zones of the sole have a resistance to abrasion coefficient measured under the same conditions at least equal to 270.

According to the invention, the whole of the sole is made of polyethylene, the zone of greater hardness being itself made of polyethylene of the same molecular weight but with a higher crystallinity rate.

This zone of greater hardness can also be obtained by polyethylene of the same molecular weight as the rest of the sole but filled in a different manner. In particular, it is possible to reduce the quantity of carbon fillers integrated into the polyethylene in the region of the zone of greater hardness required. In fact, it is known that by integrating carbon fillers, the hardness of the polyethylene is reduced, and this particularly if the latter is obtained by sintering.

This zone of greater hardness can also be obtained by polyethylene with a different molecular weight by increasing it typically in the region where it is desired to increase the hardness of the sole.

Lastly, while the whole of the sole can be obtained by sintering, the zone of greater hardness can be obtained by extrusion, making it possible to obtain greater hardness.

BRIEF DESCRIPTION OF THE DRAWINGS

The manner in which the invention can be realized and the advantages which derive from it will emerge more clearly from the following exemplary embodiments which are given by way of non-limiting indication with reference to the attached figures.

DETAILED DESCRIPTION OF A PREFERRED EMBODIMENT

Figure 1:
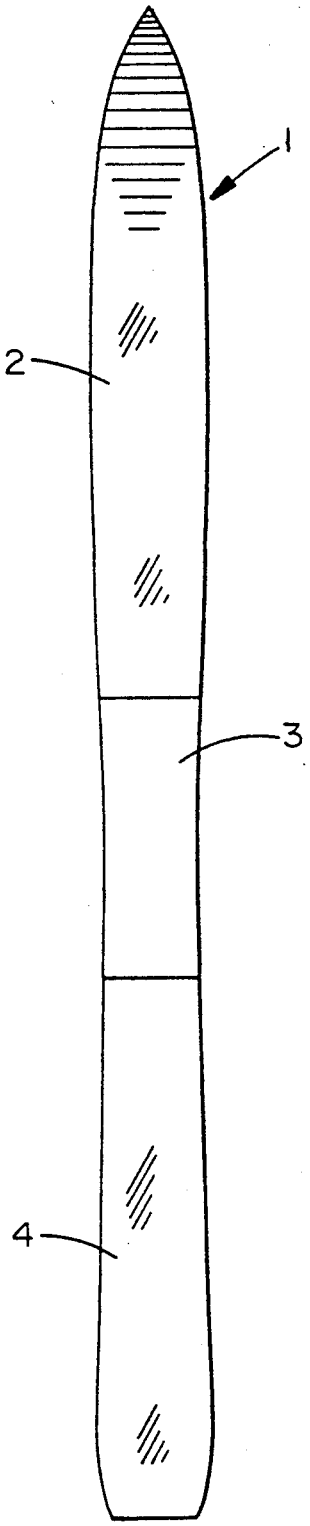
FIG. 1 is a diagrammatic representation of the bottom of a ski according to the invention.

The numerical reference (1) designates in a general manner the sole of a downhill ski. As shown in FIG. 1, this sole is divided into three surface sectors, sectors (2) and (4) corresponding respectively to the front and rear zones of the ski and sector (3) corresponding to the zone of the runner.

Figure 2:
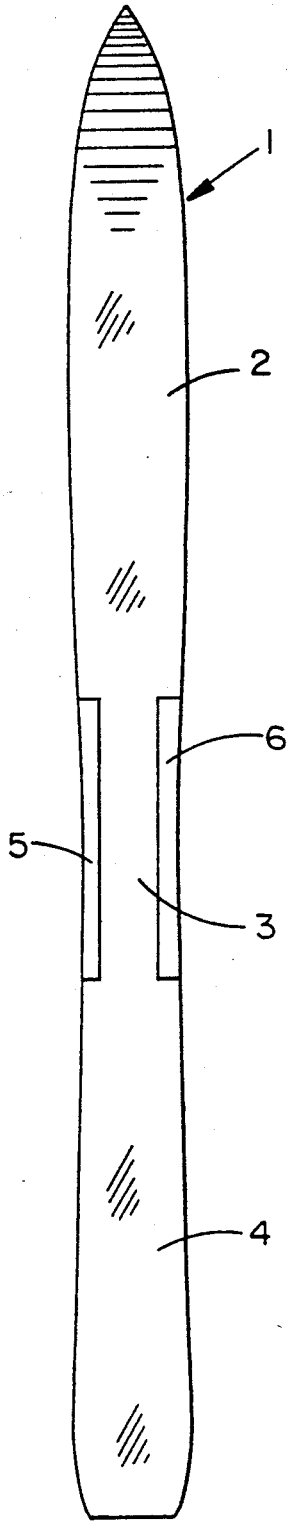
FIG. 2 is a representation similar to FIG. 1 of another embodiment of the invention.

In known manner, when the skier puts his skis on, the major part of the weight when stopped is transferred in the region of the runner. According to the invention, this zone (3) is made of a material of greater hardness than the zones (2) and (4) so as to promote sliding in particular during turns. According to the embodiment in FIG. 2, only a part of the zone of the runner is made of such a material, namely the lateral edges (5) and (6) respectively, which extend over the entire length of the zone of the runner but over a width equal to approximately one centimeter for each of these two zones (5) and (6).

In fact, only this zone is predominant during turns as it alone bears against the fold of snow created by the advance and the bearing of the ski.

Different means are obtained for modifying the hardness of this zone of the runner. Apart from adding fillers, or varying the rate of crystallinity during the use of a polyethylene of the same molecular weight, it is also possible to carry out a modification of the molecular weight of this central zone of the runner to achieve a value close to 8 million. It is also possible to make this central zone by extruding polyethylene, the rest of the sole being obtained conventionally by sintering. Finally, it is possible to envisage using two different materials, namely polyethylene for the major part of the sole and a harder and more abrasion-resistant material for the zone of the runner. Such a material can for example be constituted by polyurethane.

As is known, the sole is made prior to the production of the ski. Once the ski has been made, in particular by molding, the machining of the sole is carried out in a known manner. Taking account of the use of two different materials and in particular of a harder material in the region of the zone of the runner, a more rounded appearance is obtained for the latter, while the rest of the sole has a more uneven roughness, thus promoting sliding.

The SAND-SLURRY tests carried out show a resistance to abrasion of 100 and advantageously of 90 for the zone of the runner (3, 5, 6) and of 270 for those of two front (2) and rear (4) portions.

In fact, the sole according to the invention has very good sliding characteristics, in particular for heavy use of the skis in turns.

We claim:

1. A ski sole for covering the bottom of a ski to provide a snow contact surface, said sole being divided into a midregion runner section and front and rear end sections, said midregion runner section being situated between the front and rear end sections and having at least one predetermined area thereof fabricated of a material having a greater hardness than the front and rear end sections and said midregion runner section having a lower coefficient of friction than the front and rear end sections.

2. The ski sole of claim 1 wherein the entire midregion runner section is fabricated of said material having a greater hardness than the two end sections.

3. The ski sole of claim 2 wherein the ski sole is made of polyethylene and the resistance to abrasion measured by a Sand-Slurry test is equal to or less than 100 in the runner section and equal to or greater than 270 in the front and rear end sections.

4. The ski sole of claim 3 wherein the resistance to abrasion in the runner section is equal to or less than 90.

5. The ski sole of claim 3 wherein the runner section has a higher crystallinity rate than the other sections.

6. The ski sole of claim 3 wherein the runner section has a greater molecular weight than the other sections.

7. The ski sole of claim 3 wherein the runner section is formed by extrusion and the other sections are formed by sintering.

8. A ski sole for covering the bottom of a ski to provide a snow contact surface, said sole having a midregion runner section containing two edge regions running along opposite lateral edges of the runner section and a central region between the two edge regions, and a front end section in front of the midregion runner section and rear end section behind the midregion runner section, said lateral edge regions being fabricated of a material having a greater hardness than the front and rear end sections and the central regions of the sole and said lateral edge regions having a lower coefficient of friction than the front and rear end sections and the central region.

9. The ski sole of claim 8 wherein the lateral edge regions are about one centimeter in width.

10. The ski sole of claim 8 wherein the lateral edge regions have a resistance to abrasion as measured by the Sand-Slurry test that is equal to or less than 100 and the other sections of the sole having an abrasion resistance equal to or greater than 270.

11. The ski sole of claim 8 wherein the lateral edge regions have a high crystallinity rate than the other sections.

12. The ski sole of claim 8 wherein the lateral edge regions have a greater molecular weight than the other sections.

13. The ski sole of claim 8 wherein the lateral edge regions are formed by extrusion and the other sections by sintering.

14. The ski sole of claim 10 wherein the abrasion resistance of the lateral edge regions is equal to or less than 90.

15. A ski sole for covering the bottom of a ski to provide a snow contact surface, said sole being divided into front and rear end sections and a midregion runner section, said front and rear end sections being fabricated from a material having less hardness than the average hardness of the material forming said midregion runner section and said midregion runner section having a lower coefficient of friction than the front and rear end sections.

* * * * *